United States Patent [19]

Simovits, Jr. et al.

[11] 4,400,645

[45] Aug. 23, 1983

[54] CRT SOCKET ASSEMBLY

[75] Inventors: Stephen J. Simovits, Jr., Downers Grove; Christ J. Dumas, Forest View, both of Ill.

[73] Assignee: American Plasticraft Company, Chicago, Ill.

[21] Appl. No.: 280,682

[22] Filed: Jul. 6, 1981

[51] Int. Cl.[3] ..... H01J 29/96

[52] U.S. Cl. ..... 313/325; 315/3; 339/155 R

[58] Field of Search ..... 339/143 T, 111, 143 R; 361/119, 117; 313/325, 477, 414; 315/3

[56] References Cited

U.S. PATENT DOCUMENTS

| | | | |
|---|---|---|---|
| 2,966,608 | 12/1960 | Magnusson | 361/275 |
| 3,240,980 | 3/1966 | Schuster | 313/325 |
| 3,865,452 | 2/1975 | Pittman | 313/225 |
| 4,143,298 | 3/1979 | Bing et al. | 315/3 |

FOREIGN PATENT DOCUMENTS

| | | | |
|---|---|---|---|
| 213084 | 3/1924 | United Kingdom | 338/140 |

*Primary Examiner*—Maynard R. Wilbur
*Assistant Examiner*—Marian R. Gordon
*Attorney, Agent, or Firm*—Wallenstein, Wagner, Hattis, Strampel & Aubel

[57] ABSTRACT

A cathode ray tube socket, including a thick film ceramic plate mounted thereon and forming electronic control circuitry in association with the socket structure.

5 Claims, 4 Drawing Figures

FIG. 1
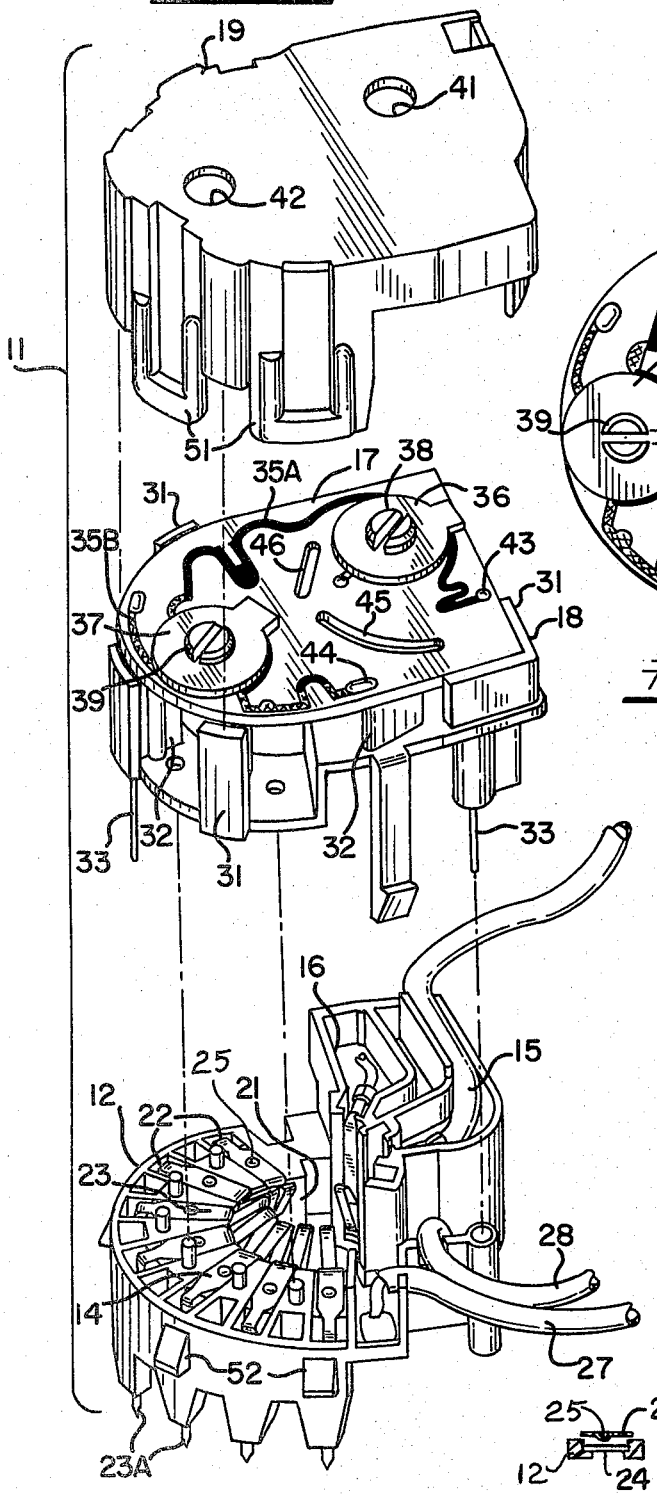
FIG. 2
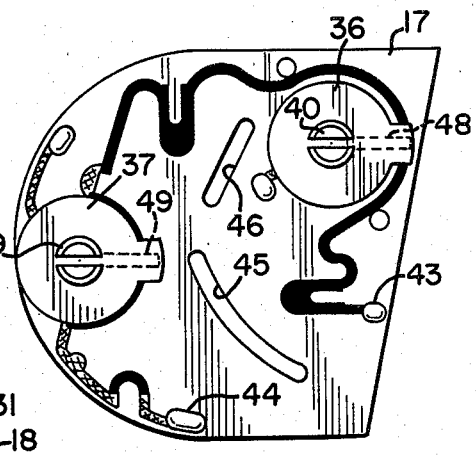
FIG. 2A
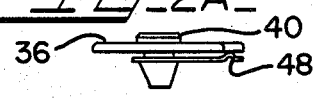
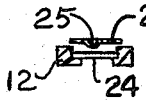
FIG. 1A

CRT SOCKET ASSEMBLY

BACKGROUND OF THE INVENTION

As is known, cathode ray tubes (CRT), such as used in television receivers, commonly generate undesired large transient voltages within the tube. Such voltages must be controlled and dissipated in order to avoid conduction of these high voltages through the tube pins and tube socket contacts to other portions of the circuitry associated with the tube; otherwise, these large voltages may damage the tube and the tube terminals, and may also couple to, and damage, the associated electronic circuitry.

Such large voltage transients may be due to arcing, which is a result of the ionization and breakdown of air or other gas media between two or more points of high potential difference. When arcing occurs, this excessive high voltage transient over-stresses the picture tube, high voltage components and wiring, which may damage the tube and associated circuitry.

In order to dissipate the excessive voltages, CRT sockets are normally provided with some type of safety device, in the form of a grounding apparatus. Thus, in the event that a particular pin has an excessive potential impressed thereon, the grounding apparatus permits a spark to jump, or arc, from the pin contact to ground. The foregoing prevents damage due to excessive potential at the particular pin by providing non-destructive path to ground, to thus eliminate the over-voltage.

In addition, various tube leads must be operated at different potentials in order to perform the desired function. Further, the potential to the leads should be adjustable to compensate for variations in the desired voltage. Such variations may be due, such as for manufacturing tolerances or various environmental conditions, including varying supply voltages. Most frequently, the voltages that must be controlled are the focusing voltage coupled to the first grid ($G_1$) of the CRT, and a second voltage coupled to the accelerating grid ($G_2$) of the picture tube.

Heretofore, in the prior art, sockets have been built to provide the spark or arc gap apparatus and to provide an adjustable voltage feature, as, for example, in U.S. Pat. No. 3,251,016 to Manetti, et al., and assigned to the same assignee as the present invention. Other devices are known, which have included the positioning of a printed circuit board adjacent to the CRT socket.

SUMMARY OF INVENTION

The present invention provides an improved CRT socket with an arc gap structure, and including a thick film ceramic plate or printed circuit board mounted thereon for providing an adjustable voltage capability.

BRIEF DESCRIPTION OF THE DRAWINGS

The foregoing features and advantages of the present invention will be apparent from the following more particular description of the invention. The accompanying drawings, listed hereinbelow, are useful in explaining the invention wherein:

FIG. 1 is an exploded isometric view of the inventive socket;

FIG. 1A is a cross-sectional view taken across a terminal pin (see lead numbered 23 in FIG. 1);

FIG. 2 is a top plan view of the thick film ceramic plate of the inventive socket; and FIG. 2A is a side view of wiper 40 of FIG. 2.

DESCRIPTION OF INVENTION

As mentioned above, the present invention is directed to an improved cathode ray tube socket assembly, including a thick film ceramic plate, enclosed within the body of the socket and forming a part of said socket.

FIG. 1 shows an exploded view of the inventive socket assembly, formed or molded of a suitable relatively rigid insulative plastic material generally referenced by the numeral 11. Socket assembly 11 consists of a base 12, including a relatively low voltage spark or arc gap control module, generally referred to as 14 and to be explained hereinbelow, and relatively higher voltage spark gap protection modules 15 and 16, also to be explained hereinbelow. A ceramic plate 17 is mounted on a plate support 18. A cover or cap 19 fits over and around support plate 18 and base 12. Base 12 includes a central opening 21 extending therethrough and a series of positioning holes 22 extending around the periphery of the base 12. Holes 21 receive the axially extending connecting portion of connector or terminal pins 23. The pins 23 include the end portions 23A, which are affixed to associated circuitry (not shown). The connector pins 23 are similar to those shown and described in U.S. Pat. No. 3,636,412, issued to Simovits and Dumas, the same inventors as in the present application, which patent is assigned to the same assignee as the present application and which patent is incorporated herein by reference.

Encapsulated within the base 12 is a metallic conductor 24, which is shown in cross-section in FIG. 1A and which extends between the opening 21 and the periphery of the base 12 in a semicircular configuration. The terminal pins 23 extend transversely to conductor 24, in spaced relation thereto. Selected terminal pins 23 include downwardly depending protrusions or dimples 25, which extend toward the metallic conductor 24. A recess 26 is formed on the surface of base 12, in positions between the dimples 25 of selected terminal pins 23 and the conductor 24 to form a spark gap therewith, as explained in, for example, the above-noted U.S. Pat. No. 3,251,016 to Brugger and Manetti, et al., which is assigned to the same assignee as the present application and which patent is incorporated herein by reference. Thus, the terminal pins 23 and ring 24 provide the low voltage spark gap module 14. As also described in the aforementioned two patents, low voltage spark gap modules include suitable connecting leads 27 and 28, which connect to the appropriate electronic circuitry.

As mentioned above, in addition to the low voltage spark gap protection circuit 14, the socket assembly 11 includes two high voltage spark gap protection modules 15 and 16. The socket assembly 11 is thus a tri-potential socket, i.e., it provides a low voltage arc gap protection module, an intermediate voltage arc gap protection module and a high voltage arc gap protection module 16. The low voltage arc gap protection module is essentially separated from the higher voltage protection modules, such as, for example, discussed in U.S. Pat. No. 3,865,452, issued to R. B. Pittman, which patent discloses the structure for separately grounding the low voltage module from the high voltage module. Separate grounding prevents a spark from jumping from the high voltage pin to ground and then back to one of the remaining pins. In the present invention, a third separate arc gap module is provided. In this latter case, the intermediate voltage may also be separately grounded from the high voltage and the low voltage arc gap protection modules.

Thick film ceramic plate 17 includes thick film circuits 35A and 35B formed thereon, and comprises essentially a voltage divider network for providing a selected voltage to the $G_1$ pin or focusing electrode of the CRT and to the $G_2$ pin or accelerating anode of the CRT. The ceramic plate 17 is formed to conform to the shape or periphery of the support 18, which support, in turn, conforms and accommodates the dimensions, projection and outline of the base 12, as is well-known in the art. The support 18 includes upwardly extending flanges, generally labeled 31, which surround the periphery of the plate 17. Further, the support 18 includes upstanding shoulders, generally labeled 32, on which the plate 17 rests. The plate is mounted in position by extending the wiring connecting to the plate 17 through suitable holes formed, such as on the shoulders 32 of the support 18, to extend the connecting lead 33 downwardly therethrough. As the lead 33 is pulled downwardly, the plate is caused to be firmed against the top of the shoulders 32.

A portion of the thick film, labeled 35A, is of a carbon-base material, while the portion of the film labeled 35B is of a silver conductive material. A pair of suitable rotatably adjustable contactor carriers 36 and 37 (see FIG. 2A) are positioned in spaced relation along the thick film circuit. Each carrier 36 and 37 carries a metallic contactor 48 and 49, respectively. The contactor carriers 36 and 37 are positioned on the upper surface of the ceramic plate 17, and include respective screwdriver adjustments 38 and 39. These screwdriver adjustments 38 and 39 are accessible through holes 41 and 42, formed in cover 19. The contactors 38 and 39 may be generally similar to those shown in U.S. Pat. No. 3,898,606, issued to Dumas and Aubel, and assigned to the same assignee as the present invention.

As will be appreciated, a high input voltage can be connected to one terminal, such as 43 of the thick film circuit 35, and the opposite terminal 44 connected to ground reference. The adjustable contactors 48 and 49 pick off a selected voltage and couple to the desired pin, as is well-known in the art. In the present invention, contactor 48 connects a voltage to the pin connecting to the $G_1$, or focusing electrode; and contactor 49 connects to a voltage to the accelerating anode, or the $G_2$ electrode.

Plate 17 includes a first elongated opening 45, formed between the high voltage terminal 43 on plate 17 and the ground connection 44 on plate 17. Opening 45 also provides an air gap between the high voltage 43 and the intermediate voltage connection of contactor 49. A second elongated opening 46 provides an air gap between the voltage connecting to the $G_1$ electrode and the voltage connecting to the lower voltages by contactor 49 and to ground reference 44. Openings 45 and 46 provide an improved voltage breakdown path. The combination of ceramic material and air dielectric provide a higher breakdown voltage characteristic between the high voltage points and the lower voltage points of the thick film circuit.

As indicated in FIG. 1, the support 18 fits on top of base 12; and the cover 19 fits over and around support 18, and is affixed to base 12 by latches 51, which are pushed over shoulders 52.

While the invention has been particularly shown and described with reference to a preferred embodiment thereof, it will be understood by those skilled in the art that various changes in form and details may be made therein without departing from the spirit and scope of the invention.

We claim:

1. A cathode ray tube socket for use with a tube having terminal pins normally operating at varying potentials and including means for developing controlled arc gaps for selected ones of said pins, said socket comprising a base, a support member mounted on said base and a cover, a low-voltage arc-gap module mounted on said base, a high-voltage arc gap module mounted in said base, a plate having an electronic circuit formed thereon mounted on said support, said electronic circuit comprising a resistive element, wiper contactors mounted on said plate, said cover enclosing said plate, said support on a portion of said base, said wiper elements providing a means of selectively coupling a voltage from said resistive element to selected ones of said terminal pins.

2. A socket assembly as in claim 1, wherein said plate is of ceramic and said electronic circuit includes a thick-film material formed as an elongated resistive element on one surface of said plate, and wherein said wiper contactors comprise a pair of elements positioned in spaced relation with one another to couple out adjustable voltages from said conductive resistive material.

3. A socket as in claim 2, wherein said first wiper contactor couples a voltage to the focus anode of the cathode ray tube and the second wiper contactor couples a voltage to the accelerating anode of the cathode ray tube.

4. A cathode ray tube socket as in claim 1, wherein said elongated resistive material has a first potential connected to one end and a reference potential at the other end, said resistive material extends in a circular shape, and an air dielectric barrier is formed in said plate in a location between the potential coupled to said one end and the reference potential coupled to the other end.

5. A socket as in claim 4, wherein a second air dielectric barrier is formed in a location between said first wiper element and a portion of the resistive material which is at a relatively lower potential.

* * * * *